US008904567B2

(12) United States Patent
Johnson et al.

(10) Patent No.: US 8,904,567 B2
(45) Date of Patent: Dec. 9, 2014

(54) DISPOSABLE ABSORBENT INSERT FOR AN ATHLETIC HEAD COVERING

(71) Applicant: No Sweat, LLC, Tonka Bay, MN (US)

(72) Inventors: Justin Johnson, Tonka Bay, MN (US); J. T. Johnson, Tonka Bay, MN (US); Chad Sulheim, Tonka Bay, MN (US)

( * ) Notice: Subject to any disclaimer, the term of this patent is extended or adjusted under 35 U.S.C. 154(b) by 0 days.

(21) Appl. No.: 13/709,913

(22) Filed: Dec. 10, 2012

(65) Prior Publication Data

US 2013/0205470 A1 Aug. 15, 2013

Related U.S. Application Data

(63) Continuation of application No. 12/416,529, filed on Apr. 1, 2009, now abandoned.

(60) Provisional application No. 61/041,388, filed on Apr. 1, 2008.

(51) Int. Cl.
*A42C 5/02* (2006.01)
*A42B 3/10* (2006.01)

(52) U.S. Cl.
CPC .... *A42C 5/02* (2013.01); *A42B 3/10* (2013.01)
USPC ..... 2/181.4

(58) Field of Classification Search
USPC ..... 2/181, 181.2, 181.4, 181.6, 209.12, 2/209.13, 410
See application file for complete search history.

(56) References Cited

U.S. PATENT DOCUMENTS

| | | | | |
|---|---|---|---|---|
| 1,986,312 | A | 1/1935 | Wilson | |
| 2,003,886 | A | 6/1935 | Hoffeld | |
| 4,468,817 | A | 9/1984 | Nunnery et al. | |
| 4,630,317 | A | 12/1986 | Brown et al. | |
| 4,856,116 | A | 8/1989 | Sullivan | |
| 4,941,210 | A | 7/1990 | Konucik | |
| 4,949,404 | A | 8/1990 | Fekete, Sr. | |
| 5,025,504 | A | 6/1991 | Benston et al. | |
| 5,058,210 | A | 10/1991 | Tivis | |
| 5,088,126 | A | 2/1992 | Mathis | |
| 5,313,668 | A | 5/1994 | Bogan et al. | |
| 5,317,761 | A | 6/1994 | Piche | |
| 5,432,955 | A | 7/1995 | Plotka et al. | |
| 5,553,326 | A | 9/1996 | Moore | |
| 5,566,395 | A | 10/1996 | Nebeker | |
| 5,613,248 | A | 3/1997 | Young | |
| 5,632,046 | A | 5/1997 | Green et al. | |
| D393,935 | S * | 5/1998 | Hines | D2/891 |
| D406,442 | S * | 3/1999 | Allen | D2/894 |
| 5,915,534 | A | 6/1999 | May | |
| D419,753 | S * | 2/2000 | Castelo | D2/894 |
| 6,467,095 | B1 * | 10/2002 | Nunnery | 2/181.6 |

(Continued)

*Primary Examiner* — Khoa Huynh
*Assistant Examiner* — Anna Kinsaul
(74) *Attorney, Agent, or Firm* — Adams Grumbles, LLP; Brittany Nanzig

(57) ABSTRACT

A disposable absorbent insert for fitting against a forehead-contacting, curved inside surface of a user's athletic head covering includes a moisture wicking layer; a liquid absorbent core layer; a liquid impervious layer; an adhesive layer comprising a repositionable pressure-sensitive adhesive; and a release liner layer. A top edge of the insert includes a plurality of slits to facilitate fitting of the insert onto the curved inside surface of the athletic head covering. A method of using a disposable absorbent insert on a forehead-contacting, curved inside surface of a user's athletic head covering is also described.

1 Claim, 6 Drawing Sheets

(56) References Cited

U.S. PATENT DOCUMENTS 6,477,715 B2 11/2002 Shin
6,738,985 B2 5/2004 Hahn et al.
7,966,673 B1 * 6/2011 Gibson ..... 2/425
D660,555 S * 5/2012 Stoltz ..... D2/892
2008/0301854 A1 12/2008 Kingto

* cited by examiner

DISPOSABLE ABSORBENT INSERT FOR AN ATHLETIC HEAD COVERING

CROSS REFERENCE TO RELATED APPLICATION

This application claims the benefit of priority from, and hereby incorporates by reference, U.S. Provisional Patent Application Ser. No. 60/041,388, filed Apr. 1, 2008, entitled "Disposable absorbent insert for an athletic head covering."

BACKGROUND

Sports have been a form of hobby, community involvement and source of exercise for people for decades. The athletic equipment industry is stable and is one that is becoming more and more technologically advanced. Athletes are constantly looking for new ways to enhance their performance and gain a competitive edge over their opponents.

A common problem that many athletes experience is sweat dripping from their foreheads into their eyes. Inhibiting sweat or any type of moisture from dripping down into the eyes, nose, mouth and other areas of the athlete's face will allow the athlete to concentrate on the game being played and not be distracted or uncomfortable during his or her athletic performance. The use of an insert enhances the performance of an athlete during activity by mitigating the possibility of sweat and oil dripping down onto the athlete's face during activity and impairing his or her vision.

Currently, there are a variety of moisture absorbing devices for absorbing sweat and other moisture away from the forehead of an individual during various activities. Such absorbent devices have been used as an insert in a cap, hat, hard hat or sun visor. However, a problem with many inserts is that they are difficult to clean and are not easily replaced when soiled or saturated. Moreover, many disposable inserts are not well shaped for the contours of athletic headwear.

BRIEF SUMMARY

In one aspect, a disposable absorbent insert for fitting against a forehead-contacting, curved inside surface of a user's athletic head covering comprises a moisture wicking layer; a liquid absorbent core layer; a liquid impervious layer; an adhesive layer comprising a repositionable pressure-sensitive adhesive; and a release liner layer. A top edge of the insert comprises a plurality of slits to facilitate fitting of the insert onto the curved inside surface of the athletic head covering.

In another aspect, a method of using a disposable absorbent insert on a forehead-contacting, curved inside surface of a user's athletic head covering is described. The insert comprises a liquid absorbent layer, an adhesive layer, and a release liner layer, wherein a top edge of the insert comprises a plurality of slits. The method comprises separating the release liner layer from the adhesive layer and contacting the adhesive layer to the curved inside surface of the athletic head covering while manipulating the top edge of the insert via the slits to fit the insert onto the curved inside surface of the athletic head covering without overlapping areas of the insert.

This Summary is provided to introduce concepts in simplified form that are further described below in the Detailed Description. This Summary is not intended to identify key features or essential features of the disclosed or claimed subject matter, and is not intended to describe each disclosed embodiment or every implementation of the disclosed or claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The figures and the description exemplify illustrative embodiments. The disclosed subject matter will be further explained with reference to the attached figures, wherein like structure is referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation.

It should be understood that numerous other modifications and embodiments can be devised by those skilled in the art which fall within the scope and spirit of the principles of this disclosure.

The figures may not be drawn to scale. Moreover, where terms such as above, below, over, under, top, bottom, side, right, left, etc., are used, it is to be understood that they are used only for ease of understanding the description. It is contemplated that structures may be otherwise oriented.

DETAILED DESCRIPTION

This disclosure relates to a disposable insert that wicks moisture away from the athlete's forehead and a method for its use. In particular, the disclosure relates to disposable moisture absorbing applications that are affixed to a head covering, specifically athletic head coverings used in contact sports, which include but are not limited to baseball, football, hockey and lacrosse. The disposable absorbent insert is specifically designed to fit within the aforementioned and other related contact sport head coverings. The material from which the disposable insert is comprised is not elastic. In one embodiment, the insert is made using materials similarly used in the making of feminine hygiene pads.

The disposable absorbent insert will be adhered to the forehead-contacting, curved inside surface of the athletic head covering. The insert will be easily attached to the athletic head covering immediately before athletic activity and is then removed from the athletic head covering and discarded after physical activity has ceased. In addition, a soiled insert may be replaced with a fresh insert during athletic activities (e.g., during a timeout, between periods, at halftime, etc.).

The disposable absorbent insert of this disclosure is a new form of technology that has not previously been available to the athletic equipment industry. As mentioned above, athletes are always looking for a competitive edge and are willing to pay for it. The beauty of the disposable absorbent insert is that it is inexpensive to produce and thus will be inexpensive to purchase. As athletics evolve, more and more people are beginning to stick with one sport and play it all year round. These athletes generally are the people looking for the competitive edge and will most likely be frequent purchasers of the inserts (which may be sold and packaged individually or in packs of, for example, 10-12 inserts per pack).

Figure 1:
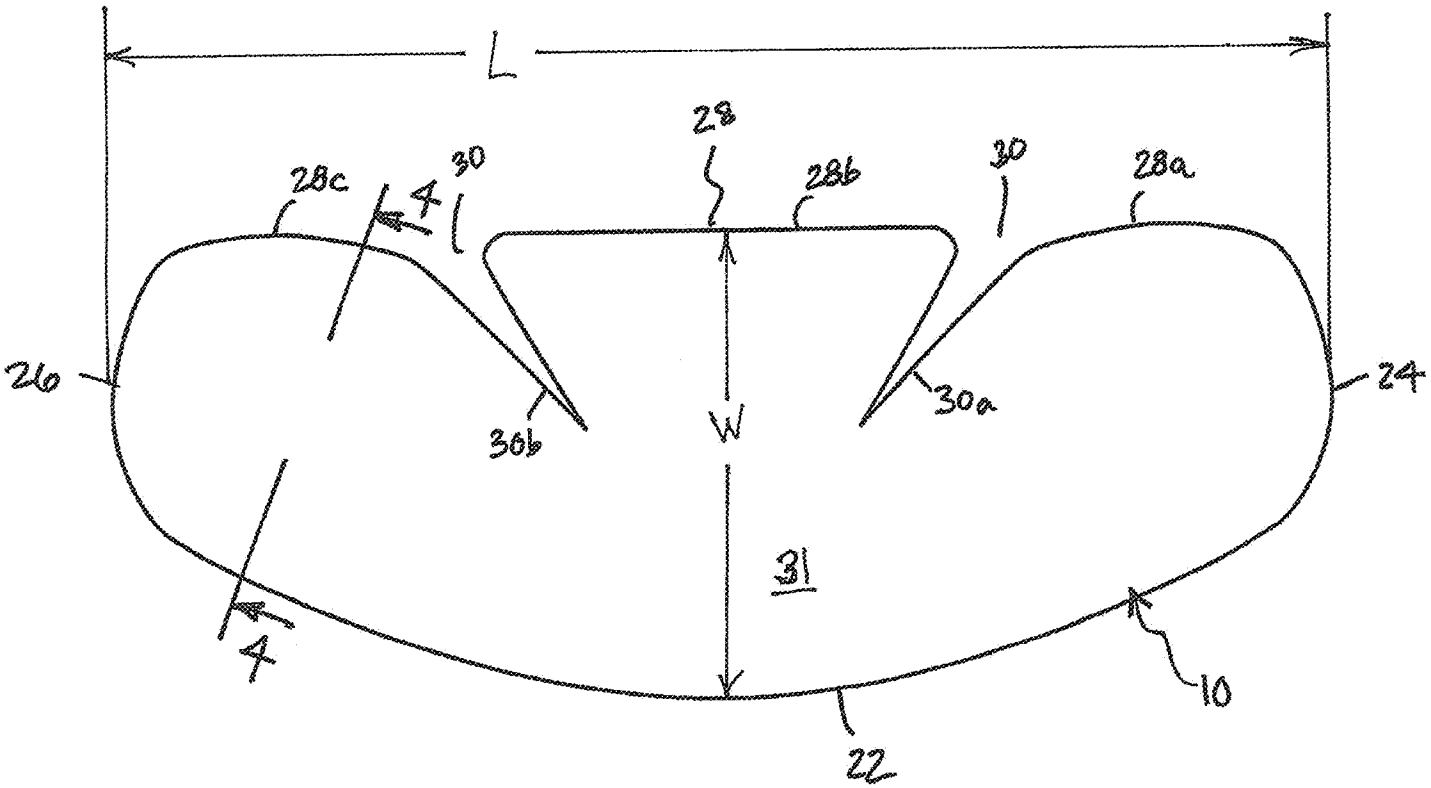
FIG. 1 is a plan view of an exemplary insert of the present disclosure.
Figure 2:
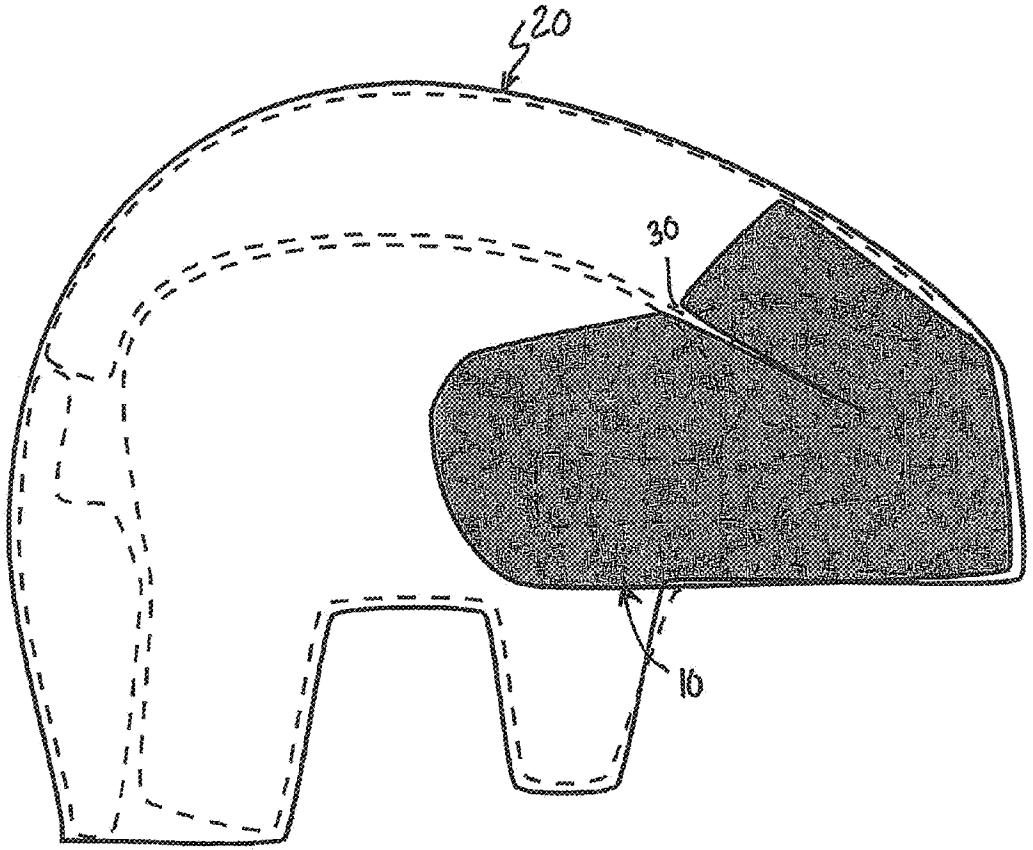
FIG. 2 is a side view of an athletic helmet, with the insert of FIG. 1 positioned inside the front portion of the helmet.
Figure 3:
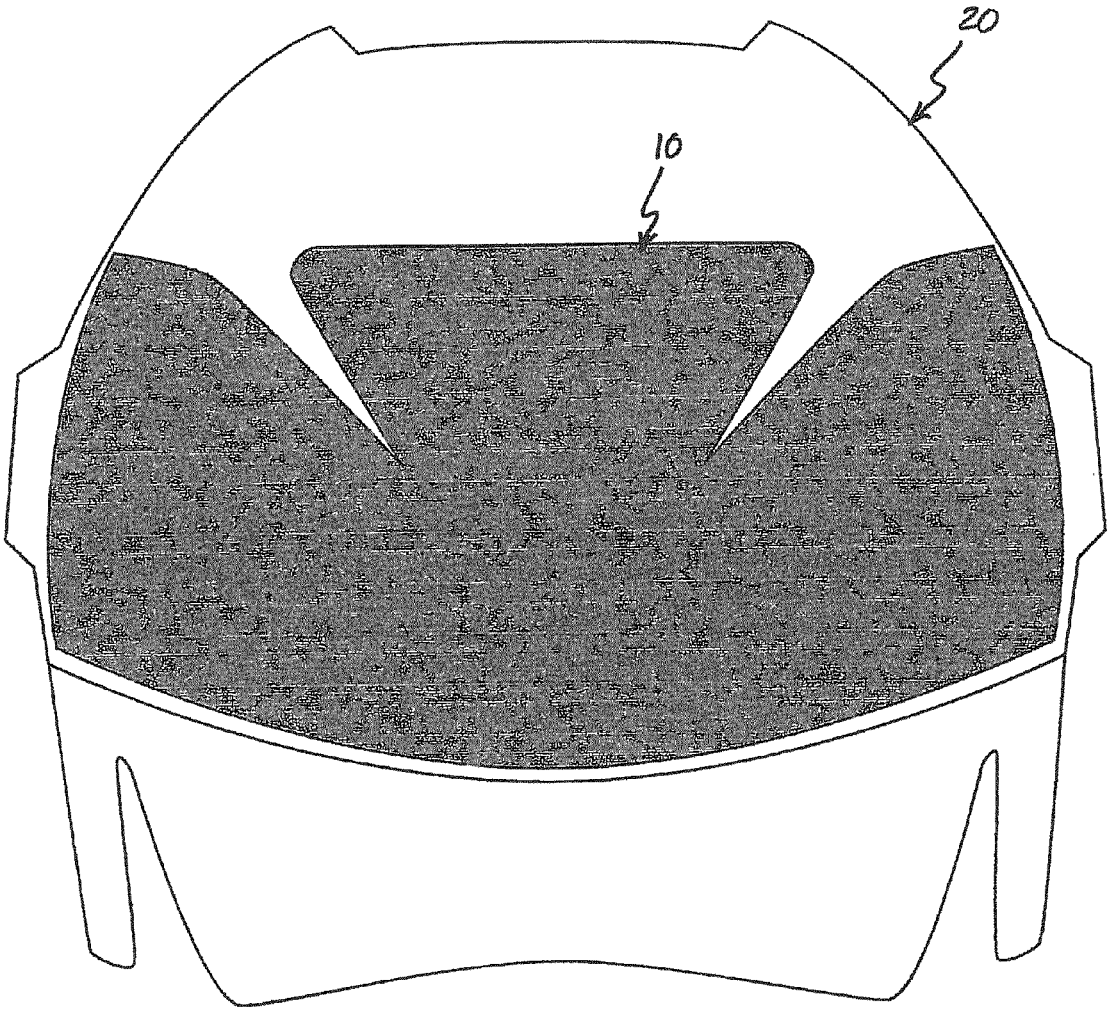
FIG. 3 is a front view of the helmet of FIG. 2.
Figure 4:
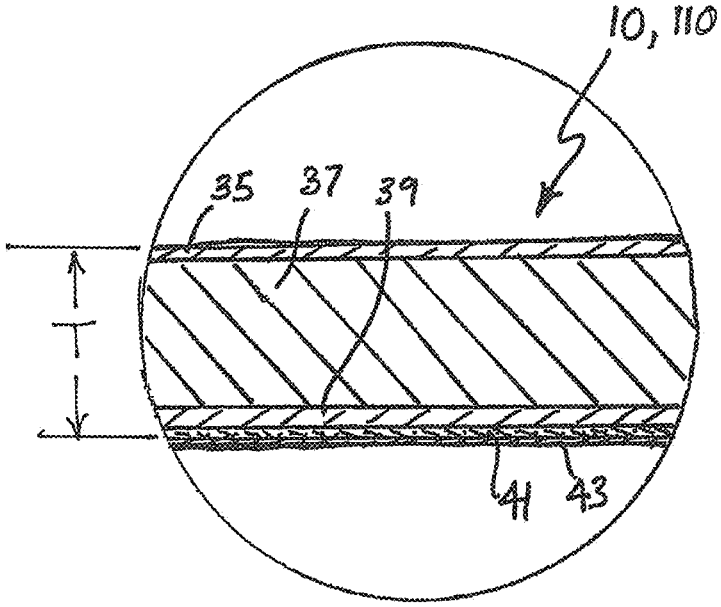
FIG. 4 is a partial sectional view of the insert, taken along line 4--4 of FIG. 1.

A disposable absorbent insert for an athletic head covering is disclosed, as shown in FIGS. 1-3. FIG. 1 is a view of an insert 10 laying flat. FIG. 2 is a side view of an athletic helmet 20 (e.g., a hockey helmet), illustrating the orientation of the insert 10 within the helmet 20, from the side. FIG. 3 is a front view of the helmet 20 of FIG. 2, illustrating the orientation of the insert within the helmet. FIG. 4 is a partial sectional view of the insert 10, such as taken along lines 4--4 in FIG. 1.

This disposable absorbent insert will be fitted against the forehead-contacting inside surface of an athletic helmet. The insert functions to wick moisture away from the forehead of the athlete and prevent moisture from dripping down into the eyes, nose, mouth and overall facial area of an athlete. The insert will be in direct contact with the athlete's forehead and will be formed of an absorbent material. In one embodiment (as illustrated in FIG. 4), the insert is comprised of several layers. These layers function to wick moisture away from the athlete's forehead, trap moisture inside the disposable insert and prevent moisture from dripping down onto the face of an athlete.

The disposable absorbent insert will benefit its user in many ways. The most apparent benefit is keeping sweat originating on an athlete's forehead and hair from dripping down onto the athlete's face. When perspiration drips down onto an athlete's face it can impair the athlete's vision, which can be a painful annoyance and disrupt the play and overall performance of the athlete during the run of play.

In some sports (e.g., hockey), many players use glass/plastic facial shields, which have a high tendency to fog up during use as perspiration and moisture enter into the area between the athlete's face and the shield. The disposable insert of this disclosure will help its user by eliminating almost all perspiration from dripping down onto the athlete's face. This will greatly decrease the probability of the glass/plastic facial shield fogging up and will not impair the athlete's vision during the run of play.

Skin hygiene is another important benefit from using the insert. Many adult and teenage athletes who wear helmets during their sporting activities experience increased skin irritation and facial acne while in season. Sweat and oil from the athlete's hair and forehead can drip down onto the face, which can plug up facial pores and cause the unwanted facial blemishes. Also, the pressure and direct contact that an athlete's forehead has with the helmet can cause skin rashes and increased acne as well. The disposable insert will prevent sweat and oil from dripping down onto the face and clogging the athlete's facial pores. The soft material of which the disposable insert is made will provide a comfortable barrier between the athlete's forehead and helmet and will eliminate skin irritation and blemishes caused by the friction between the forehead and the inside surface of the helmet.

In one exemplary embodiment, the disposable insert can be made by a manufacturer in dimensions of:

Length L: 180 mm to 330 mm (e.g., length=250 mm)

Width W: about 100 mm (e.g., width=97 mm)

Thickness T: about 2 mm to about 10 mm (or even thinner, from about 2-7 mm (e.g., thickness=4-5 mm)).

In an exemplary embodiment, each insert is generally uniform in thickness and has a lower curved edge 22 and rounded end edges 24 and 26. Each insert 10 has a top edge 28, which is interrupted by one or more slits 30. In the illustrative embodiment, two slits 30*a* and 30*b* are provided, and they are angled inwardly toward a central portion 31 of insert 10. Slits 30*a* and 30*b* allow insert 10 to naturally follow the contours of the inside curved surface of helmet 20. Moreover, such angling of slits 30*a*, 30*b* allows the slits to lie naturally along helmet 20 contour lines, such as front-to-back lines shown in FIG. 2. Accordingly, the gaps caused by slits 30*a*, 30*b* are least obtrusive to the user. The top edge 28 is thus divided into top edge portions 28*a*, 28*b* and 28*c*. Top edges 28*a* and 28*c* are generally curved, while top edge 28*b* is generally linear.

Figure 5:
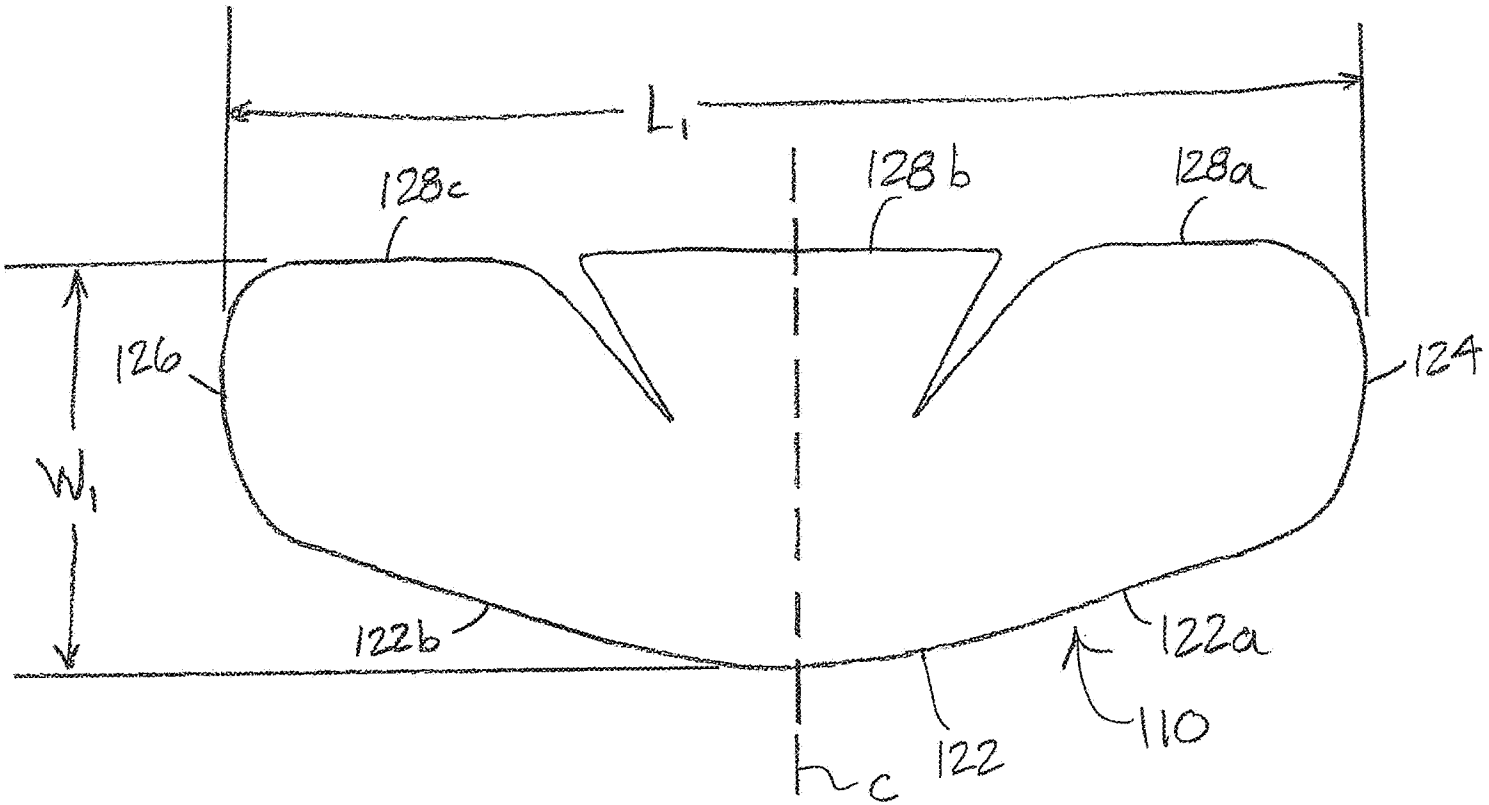
FIG. 5 is a plan view of another exemplary insert of the present disclosure.

One embodiment of a disposable insert 110 is illustrated in FIG. 5, in a plan view laying flat. This embodiment has a slightly different configuration from that illustrated in FIG. 1, with top edges 128*a*, 128*b* and 128*c* having collinear sections thereon, and with lower edge 122 having linear sections 122*a* and 122*b* between its center (about a center line C) and rounded end edges 124 and 126, respectively, of the insert 110. In one embodiment, a length $L_1$ of the insert 110 is about 248 mm and a width $W_1$ of the insert 110 is about 90 mm. The insert 110 is asymmetrical about the center line C.

The insert 10, 110 may be multilayer in construction. The layer that contacts the athlete is moisture absorbent and may have a moisture wicking functional attribute to draw sweat away from the athlete. An inner layer is also moisture absorbent and may have moisture retention attributes. The inner layer may be formed from one layer of moisture absorbent/retentive material (see, e.g., FIG. 4), or two or more layers of such material (see, e.g., FIG. 6). These moisture absorbent/wicking and moisture absorbent/retentive layers may be formed from non-woven materials including, for example, non-woven wood, wood pulp fibers, paper or non-woven absorbent polymeric fibers, or the like. For instance, in one example, the moisture absorbent/wicking layer is a perforated non-woven material, with a first moisture absorbent/retentive layer underneath it that is a non-woven (e.g., spunlace) material and a second moisture absorbent/retentive layer under the first layer, where the second layer is an absorbent paper. A moisture-barrier layer may also be provided (e.g., a polyethylene film). For example, the type of materials used for feminine hygiene pads may suffice.

A disposable absorbent insert is fitted against the forehead-contacting inside surface of an athletic head covering (see FIGS. 2 and 3). The insert functions to wick moisture away from the forehead of the athlete and prevent moisture from dripping down into the eyes, nose, mouth and overall facial area of the athlete. The insert will be in direct contact with the athlete's forehead.

Figure 6:
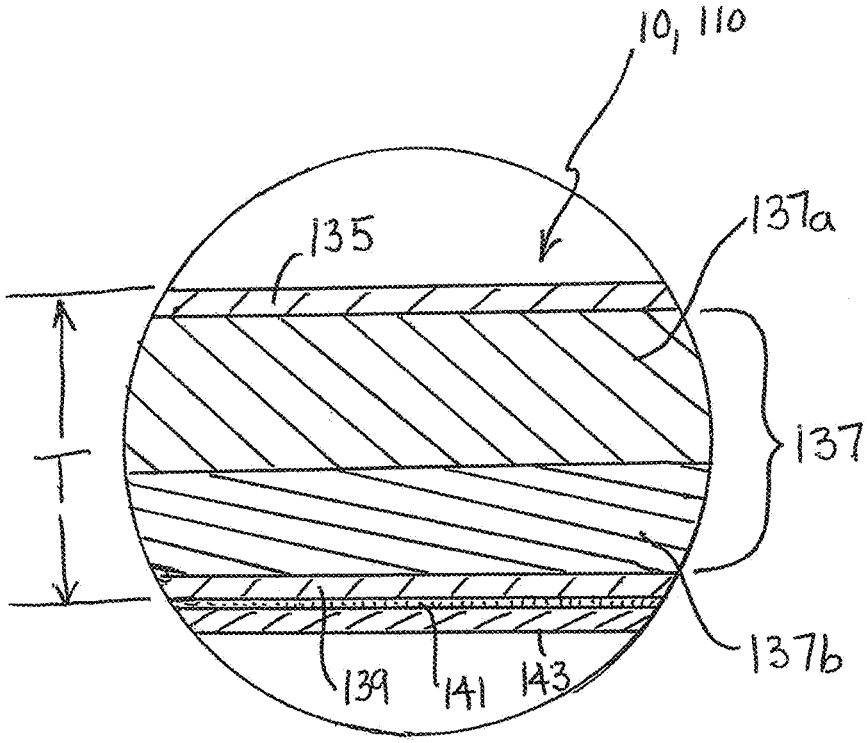
FIG. 6 is a partial sectional view of another exemplary embodiment of the insert of the present disclosure, as taken along lines 4--4 of FIG. 1.

The insert 10, 110 is formed of an absorbent material and is comprised of several layers (see, e.g., FIGS. 4 and 6). In one embodiment, the insert 10, 110 is comprised of a top-sheet layer 35 that wicks moisture away from the athlete's forehead. On a bottom-side of the top-sheet layer 35, is an absorbent core layer 37 that collects and holds the moisture that has been wicked away from the athlete's forehead. On a bottom-side of the absorbent core layer 37 is a water impervious bottom-sheet layer 39 that, along with the top-sheet layer 35, encases the absorbent core layer 37 and prohibits moisture from leaving the absorbent core layer 37.

On a bottom-side of the bottom-sheet layer 39 is a pressure sensitive adhesive layer 41 covering, in one embodiment, the entire span of a bottom-side of the bottom-sheet layer 39. This will allow the insert 10, 110 to adhere to the forehead-contacting surface on the inside of the athletic head covering 20. The adhesive of layer 41 is repositionable pressure sensitive adhesive (and may take the form of double-sided tape), which allows insert 10, 110 to be removed and discarded from a helmet (or helmet liner) without leaving adhesive residue. A removable release liner layer 43 covers the adhesive layer 41 prior to use and is removed to expose the adhesive layer 41 for mounting the insert 10, 110 within the helmet 20.

In an alternative embodiment, as seen in FIG. 6, the insert 10, 110 is comprised of a top-sheet layer 135 that wicks moisture away from the athlete's forehead. Below the top-sheet layer, an absorbent core layer 137 is comprised of a first absorbent layer 137*a* and a second absorbent layer 137*b*. The absorbent core layer 137 collects and holds the moisture that has been wicked away from the athlete's forehead. Underneath the absorbent core layer 137 is a water impervious bottom-sheet layer 139 that, along with the top-sheet layer 135, encases the absorbent core layer 137 and prohibits moisture from leaving the absorbent core layer 137.

On a bottom-side of the bottom-sheet layer 139 is a pressure sensitive adhesive layer 141 covering, in one embodiment, the entire span of a bottom-side of the bottom-sheet layer 139. This will allow the insert 10, 110 to adhere to the forehead-contacting surface on the inside of the athletic head covering 20. The adhesive of layer 141 is repositionable pressure sensitive adhesive (and may take the form of double-sided tape), which allows insert 10, 110 to be removed and discarded from a helmet (or helmet liner) without leaving adhesive residue. A removable release liner layer 143 covers the adhesive layer 141 prior to use and is removed to expose the adhesive layer 141 for mounting the insert 10, 110 within the helmet 20.

In order to use the insert 10, 110, the removable release liner layer 43 is removed from the adhesive layer 41 by peeling it from the adhesive layer 41. Insert 10, 110 is then applied to the helmet 20, either applying it directly to interior surfaces of the helmet shell itself, or to a helmet liner shaped to conform to a user's head. The repositionable pressure sensitive adhesive of the adhesive layer 41 holds the insert 10, 110 in place. The grooves 30 in the insert 10, 110 facilitate that bending of the insert 10, 110 to conform to the shape of the helmet 20, as illustrated in FIG. 2, and to prevent overlapping of the material of the insert 10, 110. By preventing such overlap, a smooth surface of insert 10, 110 lies against the user's forehead for increased comfort. After installation, the insert 10, 110 is firmly secured to the helmet 20 by the repositionable pressure sensitive adhesive, with the exposed surface of the insert 10, 110 forming a head and temple contacting surface for the wearer of the helmet 20. After use, the insert is easily removed by breaking the adhesive seal between the insert and the curved inside surface of the athletic helmet 20.

Although the disposable absorbent insert for an athletic head covering disclosed herein has been described with respect to several embodiments, workers skilled in the art will recognize that changes may be made in form and detail without departing from the spirit and scope of the disclosure.

What is claimed is:

1. A disposable absorbent insert for fitting against a forehead-contacting, curved inside surface of a user's athletic head covering, the insert comprising:

a moisture wicking layer comprising non-woven, absorbent polymeric fibers;

a liquid absorbent, retentive core layer comprising three layers including a first, absorbent, non-woven material layer, an absorbent paper layer, and a second, absorbent, non-woven material layer;

a liquid impervious layer comprising a polyethylene film;

an adhesive layer comprising a repositionable pressure-sensitive adhesive;

a removable release liner layer;

a length of from 180 mm to 330 mm;

a width of about 100 mm;

a generally uniform thickness of from 2 mm to 10 mm;

a continuous lower, curved edge having two opposing rounded end edges;

a top edge interrupted by at least two slits forming at least two gaps; and wherein the at least two gaps divide the top edge into first, second and third top edge portions;

wherein the first and third top edge portions are curved;

wherein the second top edge portion is a linear inner portion positioned between the at least two gaps; and wherein the at least two slits are angled inwardly from the top edge of the insert toward a central portion of the insert and wherein each of the at least two gaps is broadest at the top edge of the insert and tapers toward the central portion of the insert.

* * * * *